United States Patent [19]

Easley

[11] Patent Number: 4,837,056

[45] Date of Patent: Jun. 6, 1989

[54] METHOD FOR CAMOUFLAGING BOWS AND RIFLES

[76] Inventor: Samuel D. Easley, 404 N. Church, Fayette, Mo. 65248

[21] Appl. No.: 140,723

[22] Filed: Jan. 4, 1988

[51] Int. Cl.[4] ..... B05D 5/00; B05D 1/02; B05D 1/32

[52] U.S. Cl. ..... 427/262; 427/265; 427/267; 428/919

[58] Field of Search ..... 427/262, 257, 280, 267, 427/265; 428/919

[56] References Cited

U.S. PATENT DOCUMENTS

| | | | |
|---|---|---|---|
| 1,560,941 | 11/1925 | Miller | 427/267 |
| 2,015,664 | 10/1935 | Eichstädt | 427/267 |
| 2,113,449 | 4/1938 | Hoffman et al. | 427/280 |

*Primary Examiner*—Evan Lawrence

*Attorney, Agent, or Firm*—Hovey, Williams, Timmons & Collins

[57] ABSTRACT

Smooth articles such as bows and rifles are coated during a finishing process to form a rough, nubby exterior surface having a unique, three-dimensional appearance for facilitating concealment of the article among vegetation. The method in accordance with one preferred embodiment of the invention includes the steps of initially coating the object with a uniform base color such as battleship gray, and then applying splatter paint through a specially configured orifice to provide a number of raised, spaced apart images over the base color. Next, a number of removable, self-adhering templates are placed over the article in spaced relation to each other, and a second coat of splatter paint of color different than the color of the underlying discrete, splatter paint images is applied to the spaces between adjacent templates. The article thus camouflaged presents different colors in different planes in directions looking toward the article, to thereby provide a realistic duplication of the three-dimensional appearance of natural foilage.

11 Claims, 3 Drawing Sheets

METHOD FOR CAMOUFLAGING BOWS AND RIFLES

BACKGROUND OF THE INVENTION

1. Field of the Invention

The present invention relates to a method and apparatus for coating objects such as bows and rifles to provide a three-dimensional camouflaged appearance that readily blends with the three-dimensional characteristics and colors of vegetation and which also provide a rough, non-slip surface to facilitate grasping and carrying of the object. Method aspects of the invention according to one embodiment include the steps of applying paint over an object of a preselected base color to form a plurality of discrete images, and then directing a splatter coat of paint toward spaced between removable, self-adhering templates which have been placed over the images to thereby provide a varying, raised appearance which closely imitates the spatial relationship of foliage among branches or limbs.

2. Description of the Prior Art

Traditionally, hunting weapons such as bow and rifles have often been covered by paints which have been applied in a random or preselected pattern to present an appearance that is widely known as camouflage. The colors comprising the camouflage may be selected to match the colors of foliage in season in an attempt to facilitate concealment of the weapon among trees, brush, or other vegetation.

Methods for camouflaging bows and arrows in the past often include the step of applying spots or splotches of paint over a weapon having a background or base color. Typically, the dot or splotch pattern includes colors such as browns, yellows, blacks or grays that have a contrasting appearance to the base color which may be battleship gray or alternatively have a greenish cast. In some instances, stencils, masks or template are subsequently used while a third coat of paint is sprayed over the spots or dot pattern in order to simulate bark, random camo-patterns, tree limbs or the like.

Every advantage provided to the hunter, however, can significantly increase the chances for success. Consequently, there is a continuing need to improve the disguise of weapons and other objects used by hunters in order to facilitate concealment and avoid detection by game as much as possible.

SUMMARY OF THE INVENTION

My present invention improves the state of the camouflaging arts by use of apparatus and particular process steps that provide a raised, three-dimensional appearance which greatly enhances concealment of the article in outdoor environments. The finished article deflects light rays in a scattered, random pattern and thus is extremely difficult to detect among foliage such as trees or shrubs. In particular, the three-dimensional camouflage pattern as provided herein substantially conceals the planar characteristics of the exterior surfaces of the weapon to thereby increase the likelihood that the same will remain undetected by the game.

In accordance with one preferred method for camouflaging an object, I first paint the surface of the object with a background or base color such as battleship gray. Next, paint is sprayed through specially configured orifices in hand-held paddles to produce a pattern of discrete images which are preferably of at least two different colors and which contrast to the battleship gray background. Next, a plurality of self-adhering, removable templates are affixed to the object in a certain orientation and in spaced relation to adjacent templates, and a coating of splatter paint is then applied to the object to leave a raised, bumpy coating in the spaces between the templates. Finally, the masking templates are removed and the article is sealed with a waterproofing material having flat or low-luster characteristics.

As a consequence, the article when finished in accordance with my present invention presents an appearance that readily blends in with foliage and disguises the fact that the underlying, original surface of the article has a smooth or planar configuration. For example, when dark or black splatter paint is applied to the spaces between adjacent templates which are arranged to provide a tree bark or tree limb pattern, the resulting appearance closely duplicates the appearance of nature in that the colors of the tree limbs or bark are spaced from the colors resembling leaves in directions along the viewer's line of sight. As such, detection of the weapon is difficult in most circumstances.

Advantageously, the raised, nubby surfaces provided by the splatter paint serve to enhance the frictional resistance forces established between the weapon and the hunter's hands. The weapon can therefore be easily and steadily grasped for extended periods of time without slippage which is especially beneficial when moisture such as rain or ice is present.

BRIEF DESCRIPTION OF THE DRAWINGS

FIGS. 1–10 are fragmentary, side elevational views illustrating the steps for camouflaging a rifle wherein:

FIG. 1 shows a first or base coat of paint which is sprayed onto the rifle stock;

FIG. 2 illustrates the next step which comprises directing paint through a specially configured orifice of a paddle for producing discrete images or various colors which are different than the base color;

FIG. 3 depicts the next step in accordance with the invention wherein a coat of splatter paint is applied over substantially the entire stock including the discrete images and the background or base coat;

FIG. 4 shows the next step which includes the placement of removable, self-adhering templates onto the stock in a spaced apart, preselected orientation;

FIG. 5 illustrates the next step wherein a second splatter coat of dark color is sprayed toward the rifle stock;

FIG. 6 shows the next step in accordance with the present invention wherein the templates have been removed and a transparent, low-luster waterproofing coat is applied over all of the preceding coats to seal the latter from the effects of moisture;

FIG. 7 depicts an alternative method for the step illustrated in FIG. 2 wherein splatter paint is instead directed through a specially configured orifice of a hand-held paddle;

FIG. 8 depicts another form of the invention wherein roundish spots of splatter paint are applied to the rifle stock without the use of paddles instead of the step which is depicted in FIG. 2;

FIG. 9 represents another variation of the step depicted in FIG. 2 wherein elongated, generally continuous stripes of splatter paint are established on the stock; and FIG. 10 represents yet another alternative to the step depicted in FIG. 2 wherein a depiction of an object such as an elk's head is applied by use of removable, self-adhering templates amidst the strips shown in FIG. 9 to lend a personalized, custom appearance to the rifle.

DETAILED DESCRIPTION

A preferred method and apparatus for camouflaging objects such as bows and rifles is illustrated in FIGS. 1–6. However, as will be understood in the paragraphs that follow, equally satisfactory results may be obtained by varying, in accordance with the invention, one or more of the steps which have been described in detail below for exemplary purposes only.

Figure 1:
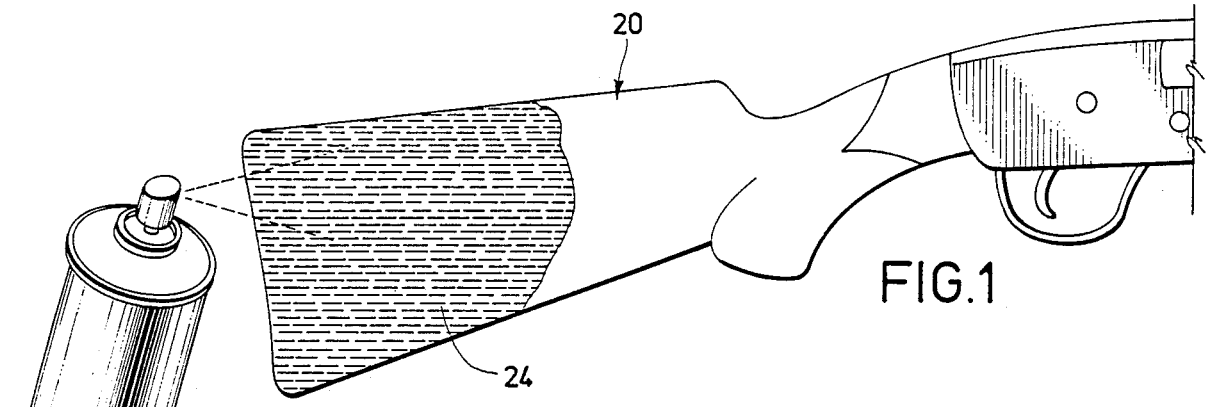

Turning initially to FIG. 1, an object such as a bow or more particularly a rifle stock 20 as illustrated in the drawings is initally prepared by removing dirt, oils or other materials which might impair the subsequent adhesion of paint. The stock 20 is then painted by means of a spray can 22 a base or background color of battleship gray, although other background colors such as those having a greenish cast might also be employed. The paint from can 22 provides a substantially uniform background color as is referenced by the numeral 24.

Figure 2:
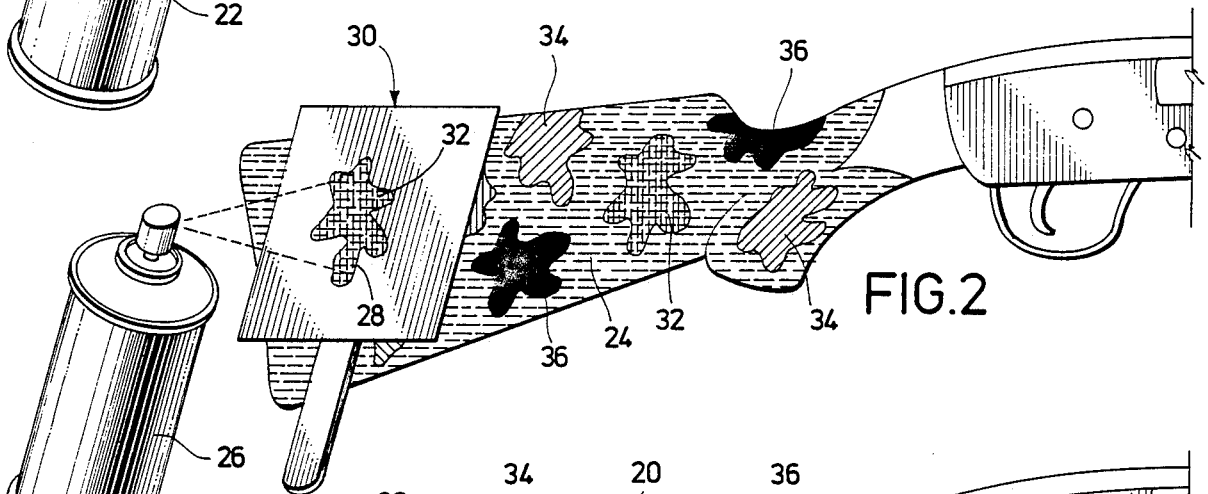

Next, paint from a second can 26 as shown in FIG. 2 is sprayed through a specially configured orifice 28 that is formed within a panel portion of a hand-held template or paddle 30 which is held at a position slightly spaced from rifle stock 20. The paint thus applied from can 26 and onto stock 20 over the background gray color 24 has a configuration complemental to the configuration of orifice 28.

Preferably, and as illustrated in FIG. 2, a number of differently colored, discrete images 32, 34, 36 are applied over the gray background color 24. Thus, while spray can 26 provides a splotch-like image of a color 32, other similar cans of paint may be used along with other paddles with somewhat differently shaped orifices to provide splotch-like images of different colors 34, 36. The images 32, 34, 36 may be colors such as brown, black, yellow, red or green.

Figure 3:
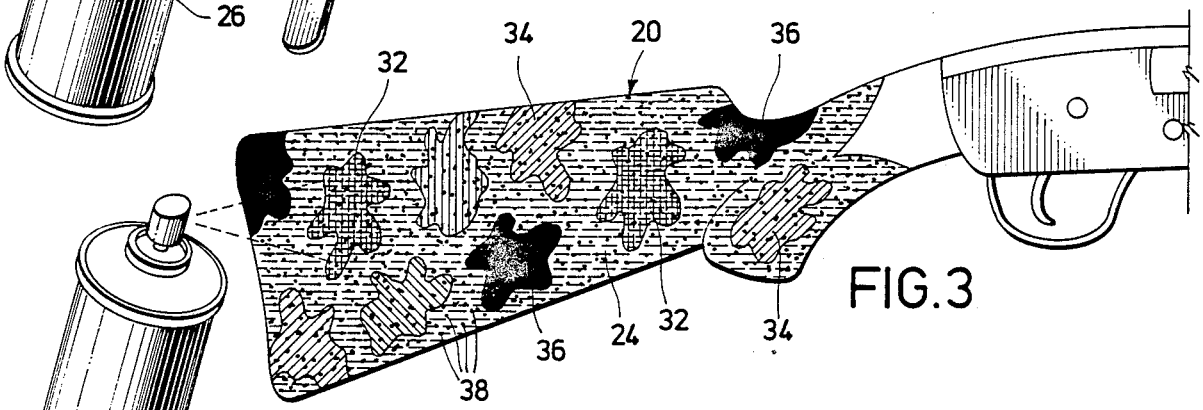

Subsequently, and referring now to FIG. 3, a coat of splatter paint 38 is applied from a spray can 40 toward the rifle stock 20 and over the images 32, 34, 36 as well as the background or base color 24. The splatter coat 38 is characterized by an essentially random distribution of relatively thick, viscous globules of paint-like material, with an absence of finer, more liquid material which might otherwise coat the spaces between adjacent globules. The globules of the splatter paint 38 thus provide a bumpy appearance without completely obscuring the background or base color 24 as well as the images 32, 34, 36.

Advantageously, the color of the splatter paint 38 is contrasting to the background gray color 24 as well as the color of images 32, 34, 36. In this regard, splatter paint 38 is comprised of green or gray globules and a few white globules although other color combinations such as black and aqua are also satisfactory. Both colors may be supplied in a single can, or alternatively two cans each of a single color may be utilized. Also, conventional squeeze bottles may be used to apply the splatter paint 38 instead of the pressurized spray can 40 shown in FIG. 3.

Figure 4:
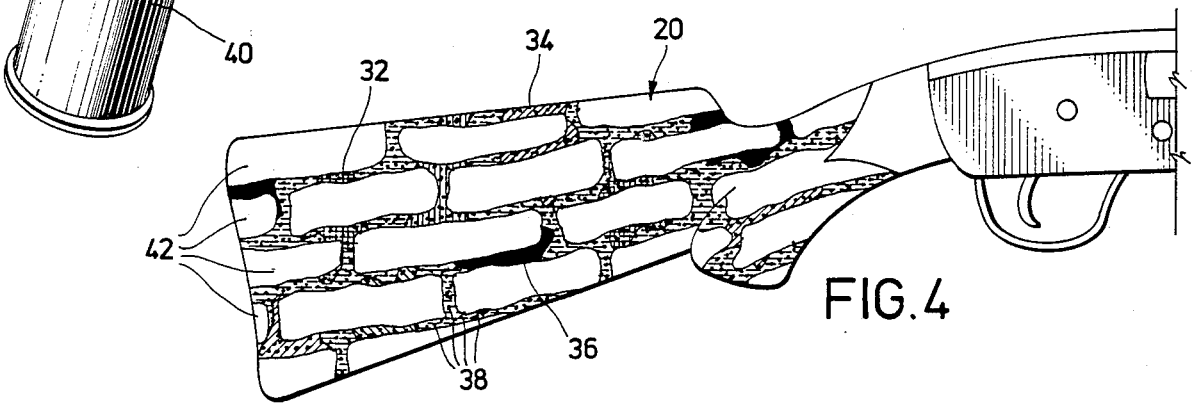

Next, a number of self-adhering templates 42 are affixed to the rifle stock 20 in spaced relation to each other as is shown in FIG. 4. Advantageously, the templates are spaced on the stock 20 to mask areas of the splatter paint 38, the images 32, 34, 36 and the background color 24 therebelow.

The templates 42 are preferably comprised of a material such as masking tape which is supplied on a suitable backing support for easy handling. Although not shown, the backing support may be provided with a series of holes between adjacent templates so that the support may be placed on stock 20 and the latter marked through the holes to later facilitate the orientation of the templates 42 on the stock 20 once removed from the backing support. Templates of other patterns other than that shown in FIG. 4 may also be used to provide a desired effect.

Figure 5:
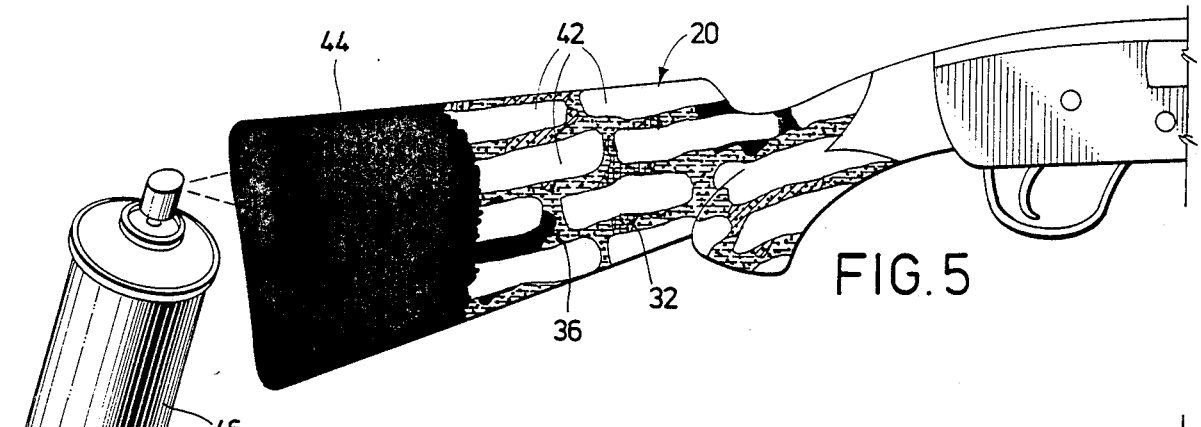

Next, a second coat of splatter paint 44 is directed from spray can 46 toward rifle stock 20 as is illustrated in FIG. 5. The splatter paint 44 thus is applied to areas of the stock 20 in the spaces between adjacent templates 42, but is prevented from reaching areas of the stock 20 directly beneath templates 42. In this instance, the splatter paint 44 is preferably substantially comprised of blackish, thick globules, with a few globules of a green or aqua color. Furthermore, sufficient splatter paint 44 is applied to the stock 20 to completely coat and thereby darken substantially the entire space between adjacent templates 42.

Figure 6:
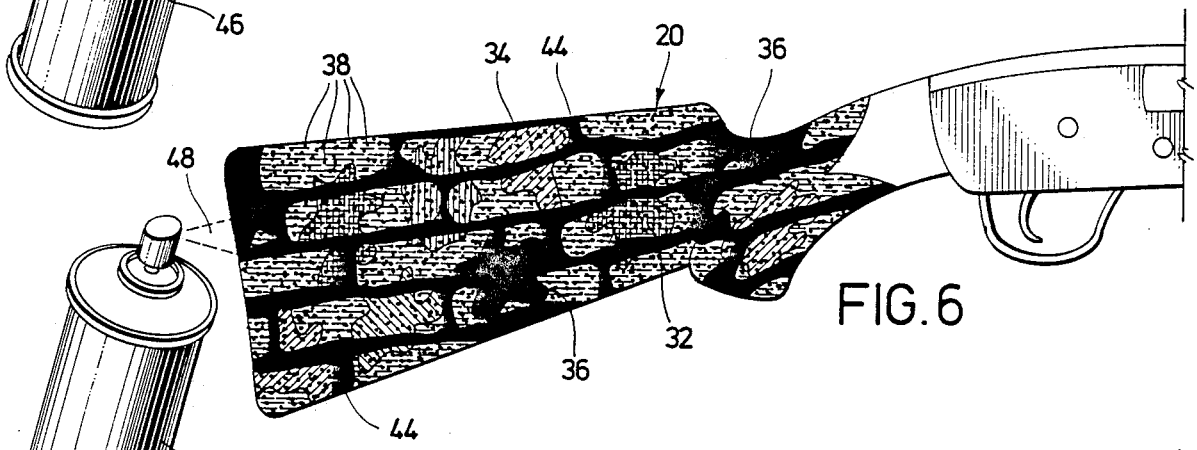

As illustrated in FIG. 6, the templates 42 are then removed from the rifle stock 20 to leave a substantially black pattern of raised paint nodules. Subsequently, a waterproofing material 48 is applied from a pressurized spray can 50 over the entire area of the rifle stock 20 to protect the latter as well as the coats of splatter paints 38, 44 which have been found as a general rule to be somewhat suscepticle to damage from moisture. The waterproofing material 48 also impairs absorption of moisture by the wooden or lamintated wood rifle stock 20 and in the case of metallic articles the waterproofing material 48 serves to inhibit corrosion. Preferably, the waterproofing material 48 has a flat or low-luster appearance.

As can now be understood by those skilled in the art, the finished, camouflaged stock 20 as represented in FIG. 6 presents a unique appearance substantially dissimilar to conventional methods and apparatus for camouflaging articles such as bows and rifles. Specifically, the use of the second splatter paint 44, applied over the first cost of splatter paint 38 as well as the images 32, 34, 36 and the background color 24, alters the originally flat, smooth exterior surface characteristics of the rifle stock 20 and instead provides a raised, especially realistic effect. The tree bark pattern provided by the second coat of splatter paint 44 stands out and away from the underlying images 32, 34, 36 to duplicate the appearance of natural foliage wherein leaves and other objects are disposed in a different plane than the surface of twigs or limbs.

In addition, the first coat of splatter paint 38, being applied substantially over the entire area of rifle stock 20, causes light falling thereon to be reflected in a scattered pattern which further conceals the fact that the underlying exterior surface of the stock 20 is smooth or falls substantially in the same plane. The first coat of splatter paint 38 thus enhances the three-dimensional effect in the spaces between adjacent areas of the second coat of splatter paint 44, and also increases the effective height of the second coat of splatter paint 44 since the latter is applied directly onto the raised globules of the first coat of splatter paint 38 in the spaces between adjacent templates 42.

Figure 7:
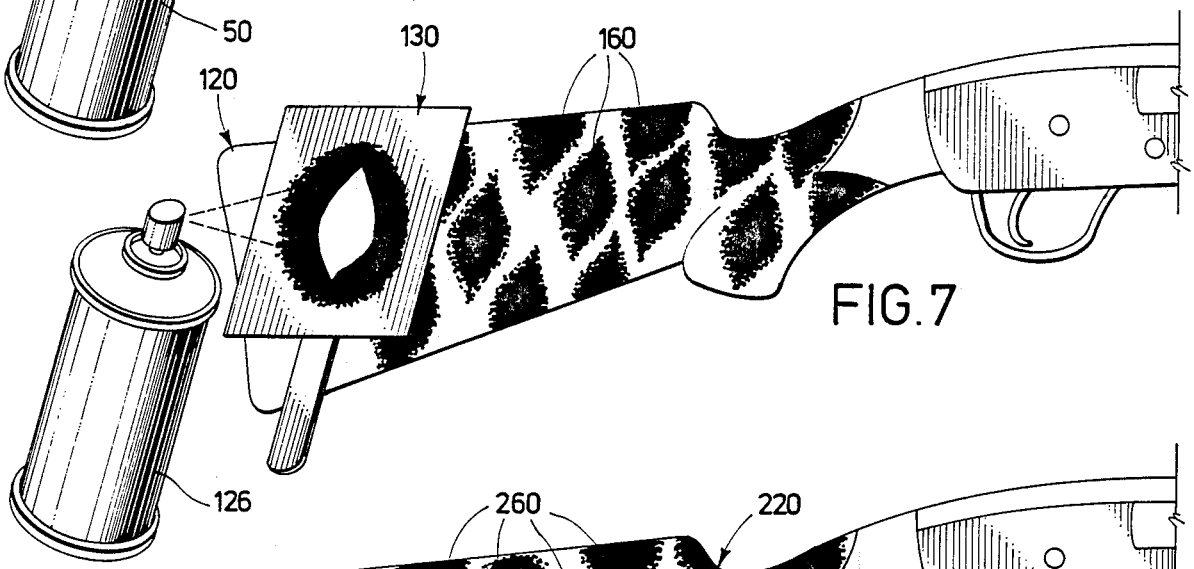

In accordance with other forms of the invention, discrete images 160 of splatter paint may be applied to rifle stock 120 as shown in FIG. 7 in substitution for the relatively liquid paint that is provided to form the smooth images 32, 34, 36 which are shown in FIG. 2. The raised, bumpy images 160 in FIG. 7 are established in this instance by spraying splatter paint from a pressurized spray can 126 through a specially configured orifice that is formed in a paddle 130 held short distance away from the surface of rifle stock 120. The splatter paint used to form images 160 may be of one, two or possibly more colors.

Although not shown in FIG. 7, the rifle stock 120 is first covered with a base or background color such as battleship gray which is shown in FIG. 1. Subsequent to the application of the splatter images 160, a second coat of splatter paint may be applied as well as a pattern produced by removable templates in the manner shown in FIGS. 3–5.

Figure 8:
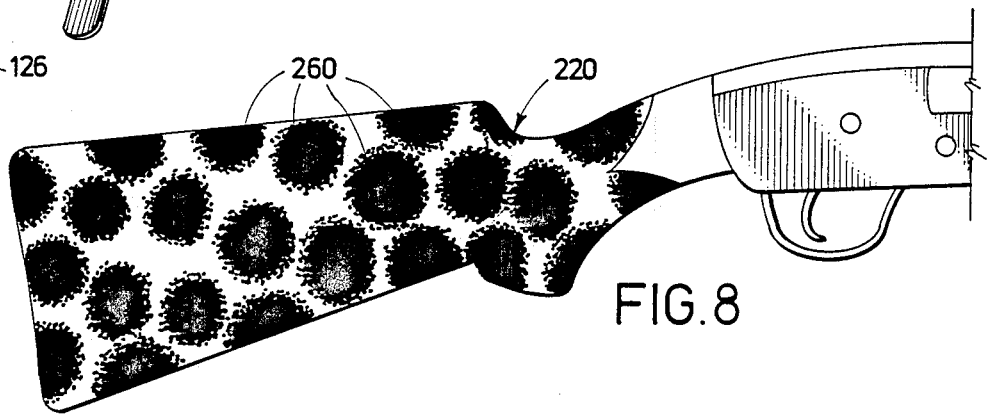

FIG. 8 represents an alternative to the step depicted in FIG. 7. In particular, FIG. 8 illustrates a number of discrete images 260 which have been formed by splatter paint applied over a uniform background color on a rifle stock 220, but in this instance the images 260 are produced by holding a spray can of splatter paint a short distance away from the stock 220 without the use of a paddle or the like, so that the images 260 are in the form of roundish, although randomly configured splotches of raised paint.

Figure 9:
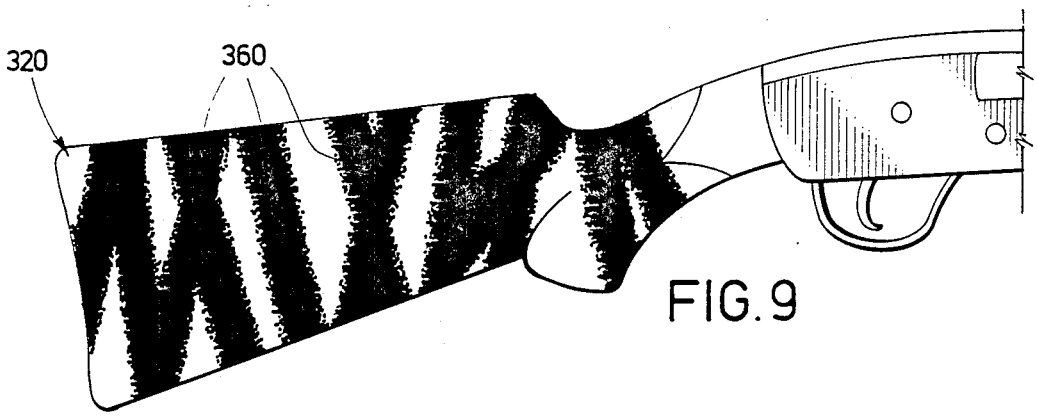

In FIG. 9, elongated "tiger" strips 360 have been formed on rifle stock 320 as an alternative to the images 160 shown in FIG. 7. In this case, self-adhering, removable templates similar to templates 42 are applied to the stock 320, and then a coating of splatter paint is directed toward the spaces between adjacent templates to provide the desired image.

Figure 10:
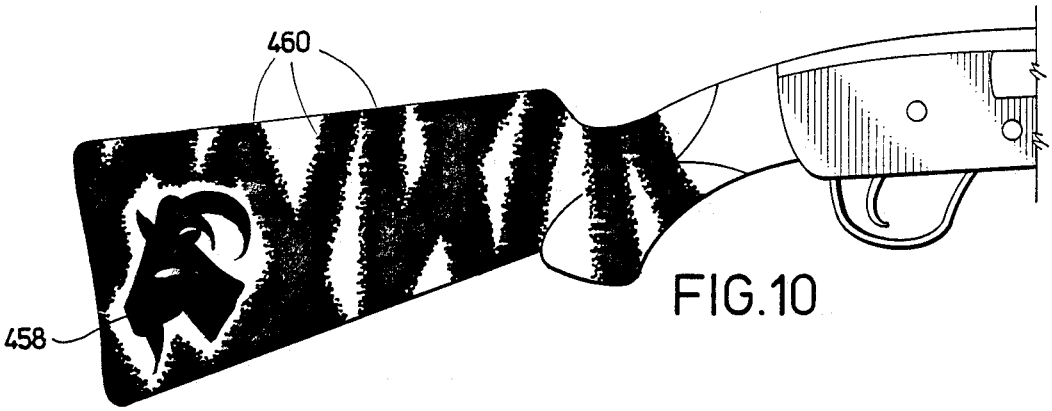

FIG. 10 represents yet another embodiment of the invention wherein a self-adhering, removable templates have been used to provide the image of an elk head 458 as well as elongated, continuous tiger strips 460 which are similar to strips 360. In this manner, the user can custom design his weapon to present a personalized, identifiable appearance. Again, the image 458 as well as the strips 460 are formed by a splatter paint, although alternatively a smooth, relatively liquid paint could instead be used.

Other variations of the invention are also possible. For example, the roundish spots which are depicted in FIG. 8 could instead be provided by use of a relatively liquid paint that provides a smooth finish. As other examples, the coat of splatter paint 38 as illustrated in FIG. 3 may be omitted if instead splatter paint is used in other steps such as that shown in FIGS. 7–10. Moreover, colors of the various images and coats may be selected in accordance with the colors of the foliage of the particular season when the weapon is to used.

I claim:

1. A method for camouflaging an object comprising the steps of:

providing an object having a preselected first color;

applying paint to said object over said first color to form a plurality of discrete images, each of said imaged being a color distinct from said first color;

directing a splatter coat of paint to said object and over said plurality of discrete images to provide a raised, three-dimensional appearance, said splatter coat being applied substantially over all of said object without completely obscuring said first color and said images, said splattern coat being a final color distinct both from said first color and from said discrete images; and affixing to said object a coat of relatively transparent, waterproofing material that cures to a low-luster appearance, whereby said object acquires such coloring, shading and general visual appearance as to be rendered substantially indistinguishable against a background.

2. The invention as set forth in claim 1, wherein said step of directing a splatter coat of paint to said object is carried out with paint of color substantially darker than the color of said discrete images to thereby simulate the appearance of branches spaced in front of foliage.

3. The invention as set forth in claim 1, wherein said step of applying paint to said object to form a plurality of discrete images includes the step of spraying said applied paint through a specially configured orifice to provide said images with a certain configuration.

4. The invention as set forth in claim 3, wherein said step of applying paint to form a plurality of discrete images is carried out with splatter paint.

5. The invention as set forth in claim 1; and including the step of removably affixing a plurality of self-adhering templates to said object prior to said step of directing a splatter coat of paint to said object in order to mask certain areas of said object.

6. The invention as set forth in claim 1, wherein said step of directing a splatter paint to said object includes the step of spraying splatter paint through an opening in a template disposed at a location spaced from said object.

7. The invention as set forth in claim 1, wherein said step of applying paint to said object to form a plurality of discrete images is carried out to present images of different colors.

8. The invention as set forth in claim 7, wherein said step of applying paint is carried out such that said images of different colors are generally of an elongated, striped configuration.

9. The invention as set forth in claim 7, wherein said step of applying paint is carried out such that said images of different colors are in the shape of roundish splotches.

10. The invention as set forth in claim 1, wherein said step of applying paint to form a plurality of discrete images includes the step of removably affixing a plurality of spaced apart self-adhering templates to said object and the step of directing paint to the spaces between adjacent templates.

11. The invention as set forth in claim 10, wherein said step of applying paint to form a plurality of discrete images is carried out with splatter paint.

* * * * *